United States Patent [19]

Gustavsson

[11] 4,398,481

[45] Aug. 16, 1983

[54] ZIGZAG MECHANISM FOR A SEWING MACHINE

[75] Inventor: Lars-Erik Gustavsson, Frolunda, Sweden

[73] Assignee: Husqvarna Aktiebolag, Huskvarna, Sweden

[21] Appl. No.: 285,957

[22] Filed: Jul. 23, 1981

[51] Int. Cl.[3] ..... D05B 3/02

[52] U.S. Cl. ..... 112/158 R

[58] Field of Search ..... 112/158 R, 221

[56] References Cited

U.S. PATENT DOCUMENTS 3,926,133 12/1975 Herron ..... 112/158 R
4,145,983 3/1979 Law ..... 112/317

FOREIGN PATENT DOCUMENTS 32485 7/1981 European Pat. Off. ..... 112/158 R
2379636 1/1978 France ..... 112/158 R
2391303 12/1978 France ..... 112/158 R
606571 11/1978 Switzerland ..... 112/158 R

*Primary Examiner*—Werner H. Schroeder
*Assistant Examiner*—Andrew M. Falik
*Attorney, Agent, or Firm*—Alfred E. Miller

[57] ABSTRACT

A frame of a needle bar mechanism is mounted in a sewing machine arm and supports the swingable needle bar holder to enable zigzag motion of the needle. A stepping motor is mounted in the frame and connected by a link from the shaft of the motor to the needle bar holder. The motor is controlled by stitch codes supplied by 8 amplifier circuits and automatic control devices. The link is formed so that the driving arrangement can be calibrated and an elastic engagement is provided between the motor shaft and the needle bar holder. The transfer distance through only one link is short so the friction loss is small. This, in combination with a small holding torque of the needle bar, restricts the dimension of the stepping motor.

9 Claims, 3 Drawing Figures

ZIGZAG MECHANISM FOR A SEWING MACHINE

This invention relates to a zigzag mechanism for a sewing machine, wherein the mechanism has a frame in the arm of the sewing machine, and the frame supports the pivoted needle bar holder which controls the zigzag motions of the needle.

A presser foot and needle bar unit with a body in the form of an elongated frame with points of attachment at both ends is disclosed in Swedish Pat. No. 370,732. The zigzag motion of the swingable needle bar holder of the unit is effected in the usual manner in mechanical sewing machines by means of a rotating curved disc and a follower transferring reciprocating movements to the needle bar holder.

In modern electronic sewing machines, a data memory and a code converter have replaced the curved disc and the follower in order to produce the zigzag motions of a seam pattern predetermined by the memory unit. A stepping motor is used as a code converted and is controlled by a stitch code supplied by amplifier circuits and automatic control devices of said memory unit. Such a stepping motor and driving arrangements can, according to the invention, be joined to the needle bar unit to form a complete, driving zigzag mechanism from which the zigzag motions are directly obtained on output of drive signals from the amplifier circuits. A composite unit of this kind can be assembled outside the machine and then placed directly in position during the assembly of the machine. It also represents an advantage from a service point, since a fault located in such a unit can easily be remedied by substituting the whole unit.

In order that the invention will be more clearly understood, it will now be disclosed in greater detail with reference to the drawings, wherein.

Figure 1:
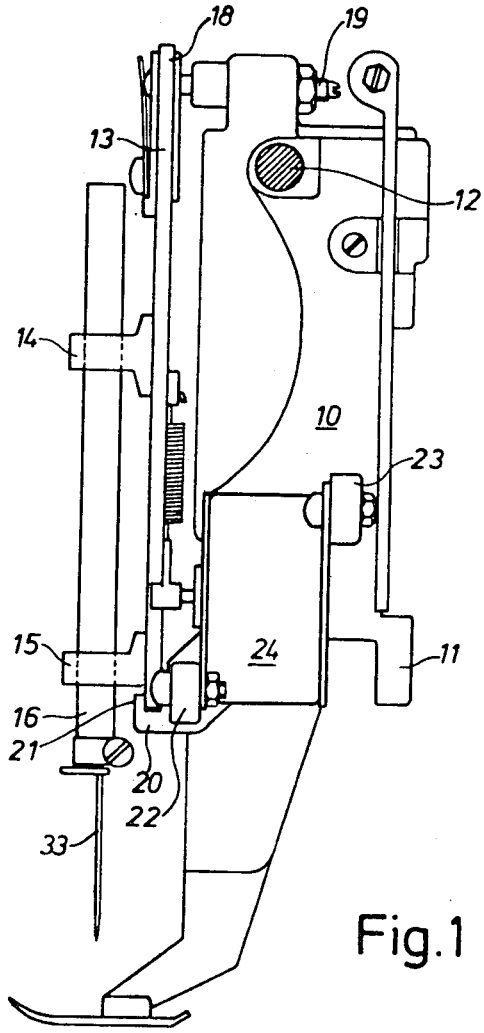
FIG. 1 is a simplified side view of a sewing machine incorporating the zigzag motion means of the invention.
Figure 2:
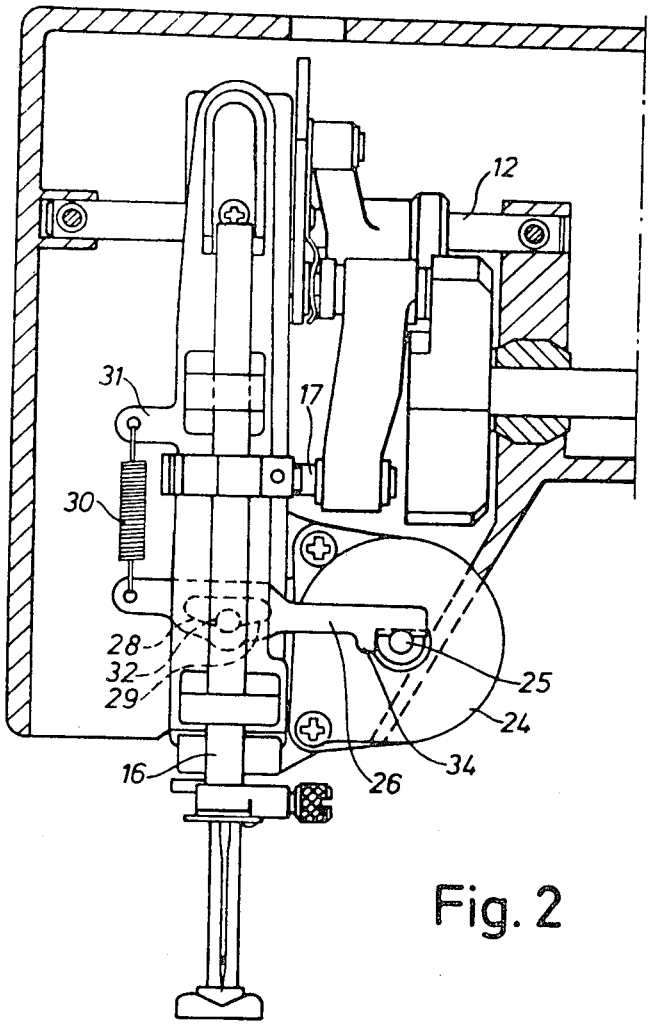
FIG. 2 is a front view of the sewing machine of FIG. 1, additionally showing a portion of the housing cross section.

The body of the mechanism is comprised of a frame 10 which has a mounting lug 11 and holes through which a bar 12 passes for securing the mechanism to the machine. The needle bar guide is comprised of a holder 13 and bearings 14, 15 mounted thereon holds a vertically movable needle bar 16. A vertically reciprocable element 17 is affixed to the needle bar 16 intermediate its ends. The holder 16 has a ball bearing 18 adjacent the top of the frame 10, and a screw 19 threaded in the frame 10, a ball on one end upon which the holder is supported. The holder 13 is thus laterally swingable and is guided at its lower end by a guiding edge 21, guide rib 20 on the frame 10.

Figure 3:
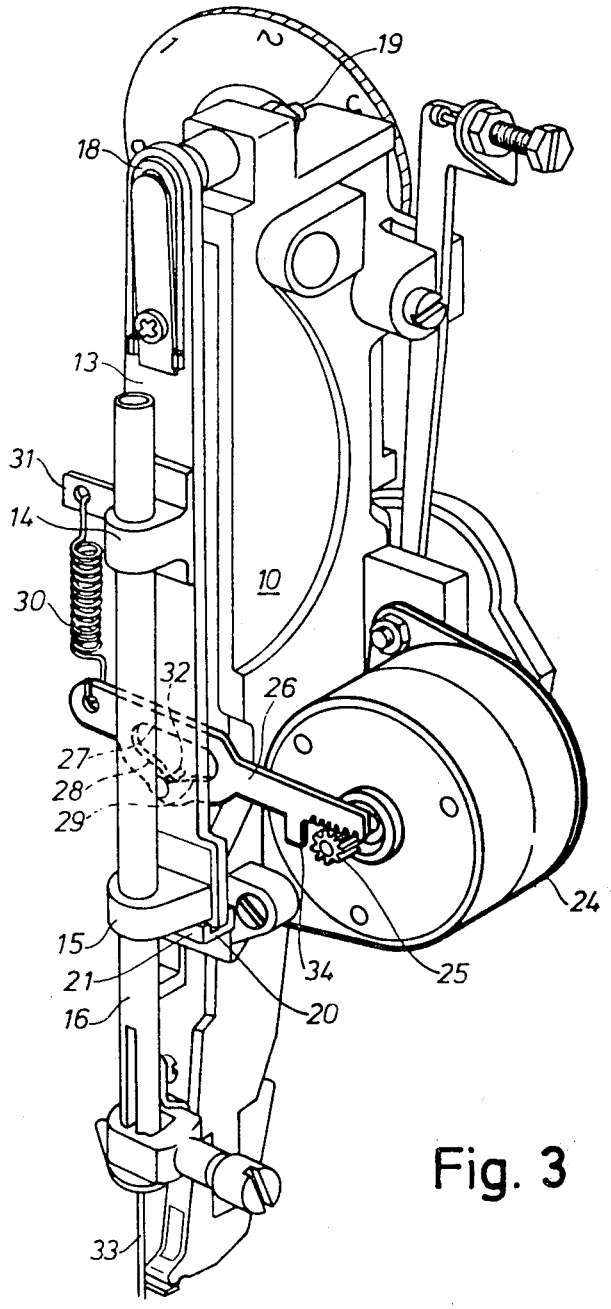
FIG. 3 is a perspective view of the zigzag mechanism of FIGS. 1 and 2.

The frame has mounting lugs 22, 23, on one side for mounting a stepping motor 24. The shaft of the stepping motor has pinion 25 meshing with a rack 26 that extends horizontally across the frame. The rack 26 has an aperture 27 approximately at its center and forming a pair of sloping side edges 28, 29 at an obtuse angle to one another, and a mounting point for a coil spring 30 at the remote end of the rack, as shown in the perspective view of FIG. 3. The coil spring is held by a lug 31 on the frame 10 and acts upwardly on said remote end of the rack. The rack is coupled by a pin 32 on the holder 13 to the holder, so that the holder 13 will follow the lateral motion of the rack. The pin is normally held in the vertex of the obtuse angle due to the spring force acting on the remote end and the sloping of the edges 28, 29, but it may slide onto one of the edges. This may, occur e.g., if the needle 33 is subjected to an external, lateral force, but when this external force ceases the pin will return to the vertex of the angle since the side edges slope in that direction. The pin 32 is also a fulcrum of the rack which thus can rotate through a small angle around the pin. This is possible by raising the forward end (the toothed end) of the rack above the pinion 25 so that the pinion is disengaged from the rack. However, the pinion is usually in mesh with the rack owing to the spring force at its remote end, since the relative positions of the rack and the pinion were adjusted during assembly.

A well-defined initial position of the stepping motor is very important for its function as a setting device for the lateral position of the needle. This is determined by the drive pulses supplied by the motor drive circuits. In the present embodiment of the rack and pinion it is possible to use a mechanical stop in the form of a dog 34 on the rack, to create a stationary well-defined position. The setting of the motor to this position, which constitutes the initial position, takes place so that the automatic control device in the machine emits a number of pulses to the input of the motor which cause the motor to step forwards to the stop. After such a series of pulses the motor is calibrated, that is to say it is set in the initial position. When the drive circuits subsequently emit a series of pulses in the other direction, the motor responds by performing a corresponding number of steps from the initial position. A calibration can occur at suitable points of time in the working of the machine e.g. at the start of any fancy seam.

The design of a rack has two purposes, first to effect an elastic engagement between the motor and the needle bar holder, the engagement being self-adjusting to the vertex of the obtuse angle in the aperture 27, and second to provide a calibration position at the stationary dog 34 from which the working range of the motor is counted. The transfer distance of the motion is short and the friction loss small. This, in combination with the small maintaining torque of the needle bar holder in the adjusted positions, enables the use of a relatively small stepping motor for zigzag control.

While the invention has been described and disclosed with reference to a single embodiment, it will be apparent that variations and modifications may be made therein. Thus, for example only, the aperture may be provided on the needle bar holder, with the pin coupled to the aperture being mounted on the rack. It is therefore intended in the following claims to cover each such variation and modification as falls within the true spirit and scope of the invention.

What is claimed is:

1. In a zigzag mechanism for a sewing machine wherein a needle bar holder is mounted to be laterally swingable, a stepping motor has a gear, and coupling means are provided between the gear and the needle bar holder to swing the needle bar holder about its swinging axis, thereby to enable zigzag sewing; the improvement wherein said coupling means comprises a first connector means on said needle bar holder elastically coupled to a second connector means engaging said gear, one of said connector means comprising an aperture and the other connector means comprising a pin mounted to elastically engage said aperture.

2. The zigzag mechanism of claim 1 wherein said second connector means comprises a rack.

3. The zigzag mechanism of claim 2 further comprising spring means coupled to said rack for resiliently urging said rack into engagement with said first connector means.

4. The zigzag mechanism of claim 3 wherein said rack has a fulcrum at said first connecting means.

5. The zigzag mechanism of claim 4 wherein said pin is mounted on said needle bar holder and said aperture is formed in said rack.

6. The zigzag mechanism of claim 1 wherein said second connecting means comprises a rack engaging said gear, said rack having a dog positioned to limit movement of said rack in one direction, thereby to define a calibration position of said stepping motor.

7. The zigzag mechanism of claim 1 wherein said aperture has a greater width than the cross section of said pin, and is shaped to have a position of equilibrium with respect to said pin.

8. The zigzag mechanism of claim 7 further comprising elastic means for urging said aperture to said position of equilibrium with respect to said pin.

9. The zigzag mechanism of claim 8 wherein said aperture has a pair of adjacent sloping edges at an obtuse angle to one another, whereby said elastic means resiliently urges said pin to the junction of said edges of said aperture.

* * * * *